United States Patent [19]

Brugman

[11] 4,095,442

[45] Jun. 20, 1978

[54] WASHING MACHINE FOR A TEXTILE WEB

[75] Inventor: Hans Brugman, Ambt-Delden, Netherlands

[73] Assignee: Brugman Machinefabriek BV, Netherlands

[21] Appl. No.: 703,377

[22] Filed: Jul. 8, 1976

[30] Foreign Application Priority Data

Jul. 10, 1975 Netherlands ..... 7508277

[51] Int. Cl.[2] ..... D06B 1/06

[52] U.S. Cl. ..... 68/18 C; 68/20; 68/205 R; 239/563

[58] Field of Search ..... 68/18 C, 20, 27, 62, 68/158, 175, 181 R, 184, 205 R; 239/563, 564

[56] References Cited

U.S. PATENT DOCUMENTS

| | | | |
|---|---|---|---|
| 2,900,991 | 8/1959 | Arnold | 68/205 R X |
| 3,100,306 | 8/1963 | Oldershaw | 68/181 R X |
| 3,158,886 | 12/1964 | Grimes | 68/18 C X |
| 3,470,571 | 10/1969 | Hrboticky | 68/205 R X |
| 3,828,589 | 8/1974 | Collinge | 68/184 X |
| 3,907,280 | 9/1975 | Bendall et al. | 239/563 X |
| 3,950,802 | 4/1976 | Schiffer et al. | 68/181 R X |

*Primary Examiner*—Philip R. Coe

*Attorney, Agent, or Firm*—Ostrolenk, Faber, Gerb & Soffen

[57] ABSTRACT

A broad washing machine comprising a housing containing several groups of guide rollers, each group consisting of two columns of parallel horizontal rollers between which a textile web is upwardly conveyed along a zig zag path consisting of short mainly horizontal loops, a receptacle being positioned under each roller for catching the cleaning liquid dripping from the web and for directing said liquid upon the upper flight of an adjacent loop.

5 Claims, 3 Drawing Figures

WASHING MACHINE FOR A TEXTILE WEB

DISCUSSION OF THE PRIOR ART

The invention relates to a washing machine for a textile web, comprising a treatment space containing a cleaning liquid which space is provided with horizontally arranged guide rollers past which the web or cloth to be washed is guided said rollers being arranged in at least one group consisting of two mainly vertical rows of parallel rollers located adjacent each other, whereinbetween the cloth is passed along a zig zag path of horizontal loops from the bottom upwards, whilst under each roller a receptacle is disposed, a supply of cleaning liquid being arranged above each group of rollers. In such a washing machine which is known in practice the web follows a path consisting of rather long horizontal loops.

Although the effect of this known washing machine is not unsatisfactory, difficulties are sometimes experienced, as the machine is not sufficiently efficient. The invention aims therefore in the first place to provide a more compact machine which at the same time has a more intensive washing effect and as a consequence a better efficiency.

SUMMARY OF THE INVENTION

According to the invention each receptacle is provided with a controllable bottom outlet, the dimensions of said receptacles being such that their sides protrude beyond both ends of the above adjacent roller, while opposite receptacles of both rows of rollers overlap each other, such that no liquid can drip further downwards than the vertical distance between two superimposed rollers. Owing thereto the floor surface of the machine can be limited, as an extension of the washing path entails only an increase of the height of the apparatus. This washing path can be two or three times as long as in the known washing machines. Moreover, the intensity of the washing operation of the present machine is considerably increased with respect to the washing machines known so far, since each horizontal loop is moistened by cleaning liquid which during the next passage past a guide roller, is pressed out and lands in the receptacle arranged under the roller.

The specific dimensions of the receptacles or trays as hereinbefore defined in relation to the length of the rollers prevent any loss of cleaning liquid dripping from the travelling web directly to the bottom of the treatment space.

In addition to the aforementioned more intensive washing effect, the washing machine according to the invention allows to use far less cleaning liquid (mostly water) than hitherto possible. As a consequence the consumption of chemicals and energy is limited and also the quantity of liquid to be discharged, which is favourable from the angle of environmental protection.

The invention further aims to treat textile webs with various widths in this type of washing machine, whereby the cleaning liquid dripping from the receptacles is restricted to the surface of the web and does not uselessly flow off on the open side. This possiblity of adaption is one of the most important features of the washing machine according to the invention.

SURVEY OF THE DRAWINGS

FIG. 1 shows a side elevation of the washing machine provided with two groups of juxtaposed rollers;

DESCRIPTION OF A PREFERRED EMBODIMENT

Figure 7:
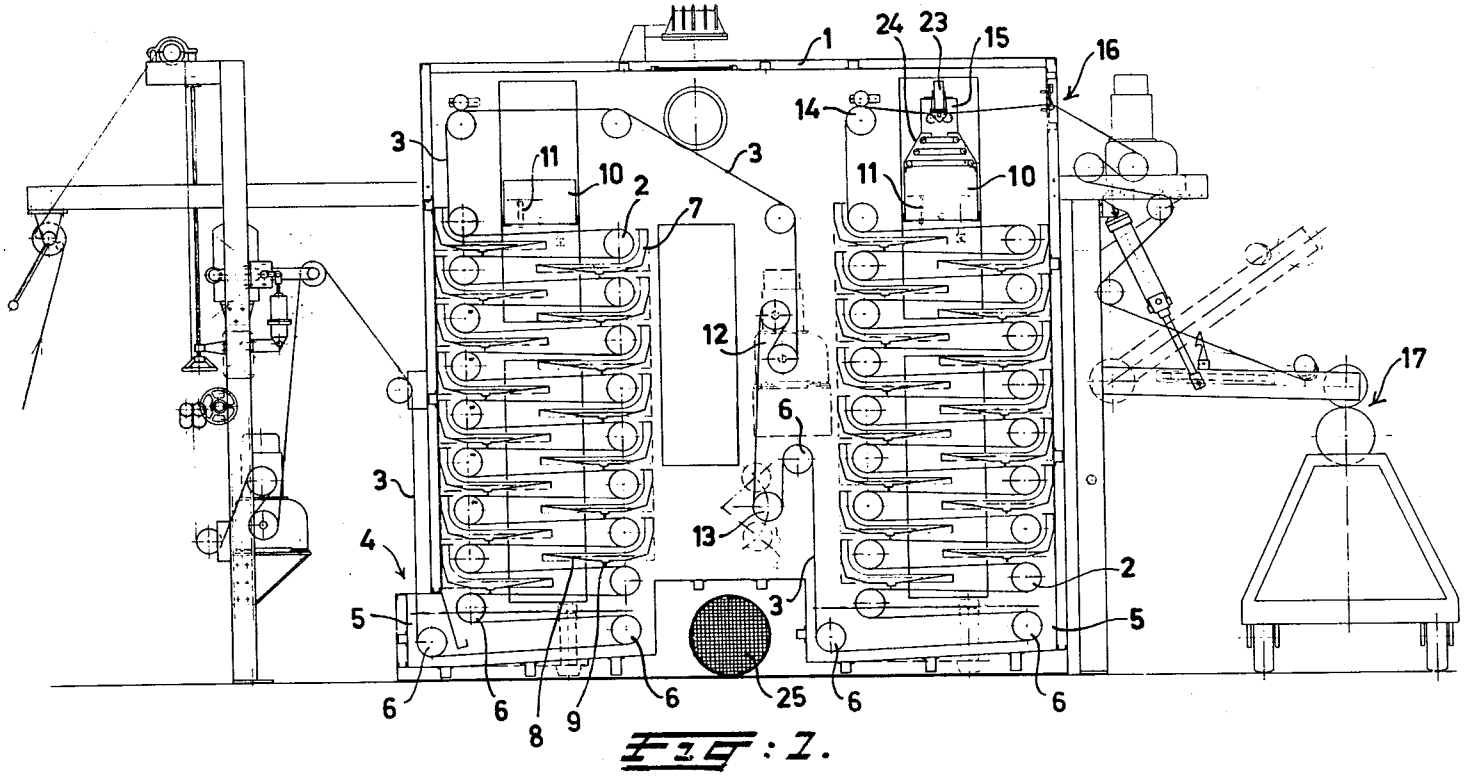

As is seen in FIG. 1 the washing machine consists of a casing 1 forming the treatment space proper. In this space are disposed a plurality of horizontally arranged guide rollers 2. In the depicted embodiment the guide rollers are arranged in two substantially identical groups, which each group consists of two rows of parallel rollers 2 situated over each other. The textile web or cloth 3 is passed from between these rollers in a zig zag path of horizontal loops. The cloth 3 is introduced through an opening 4 at the foot of the housing 1 and via a liquid bath 5. Within this bath are three guide rollers 6 via which the cloth 3 is passed to the treatment rollers 2.

A receptacle or tray 7, the bottom 8 of which is provided with discharge means consisting of a row of perforations, is disposed under each roller 2, the perforations extending in a direction which is substantially transverse to the longitudinal direction of the loop of the path situated thereunder. The length of each receptacle 7 is greater than the length of the roller 2 so that the receptacle protrudes beyond both ends of the roller. Opposite receptacles overlap each other somewhat in the middle zone between both rows of rollers. A container 10 for cleaning liquid is disposed above each group of rollers 2. A plurality of stand pipes 11 protrude through the bottom of the container and by means of these pipes the cleaning liquid can moisten the cloth 3.

At the upper end of the left-hand group of rollers in FIG. 1 the web of cloth 3 is downwardly passed, via a driving unit 12 and a compensator 13, to the liquid bath 5 of the right-hand group of rollers 2 in FIG. 1. This right-hand group which is constructed in an analogous fashion as the left-hand group, is again traversed from bottom to top in horizontal loops by the web or cloth 3. The cloth 3 is finally passed past a pressure roller 14 and a dewatering device 15, whereupon the cloth via the outlet 16 leaves the housing 1 in order to be reeled to a roll 17. The dewatering device consists of a gas nozzle 23 according to U.S. Patent Application Ser. No. 612,048 filed on Sep. 10, 1975 now abandoned in favor of U.S. Continuation Application Ser. No. 782,009, filed Mar. 28, 1977, with a condensor 24 beneath the nozzle for condensing and warming the gas (vapour) from the nozzle to produce cleaning liquid. The gas (vapour) which is passed through the nozzle 23 for the dewatering operation is firstly filtered in a fine filter 25.

Means are disposed in each receptacle 7 at the location of the perforations 9 of the bottom thereof for selectively closing one or more of those perforations. The closing means consists of a strip 18 which bears on the perforated bottom 8. The perforations 9 are provided in a recessed gutter-shaped part 19 of the receptacle in which the strip 18 is guided. The strip 18 is lengthwise slidable and connected with an operating lever 21 (see FIG. 2) via an intermediate link 20.

Figures 2, 3:
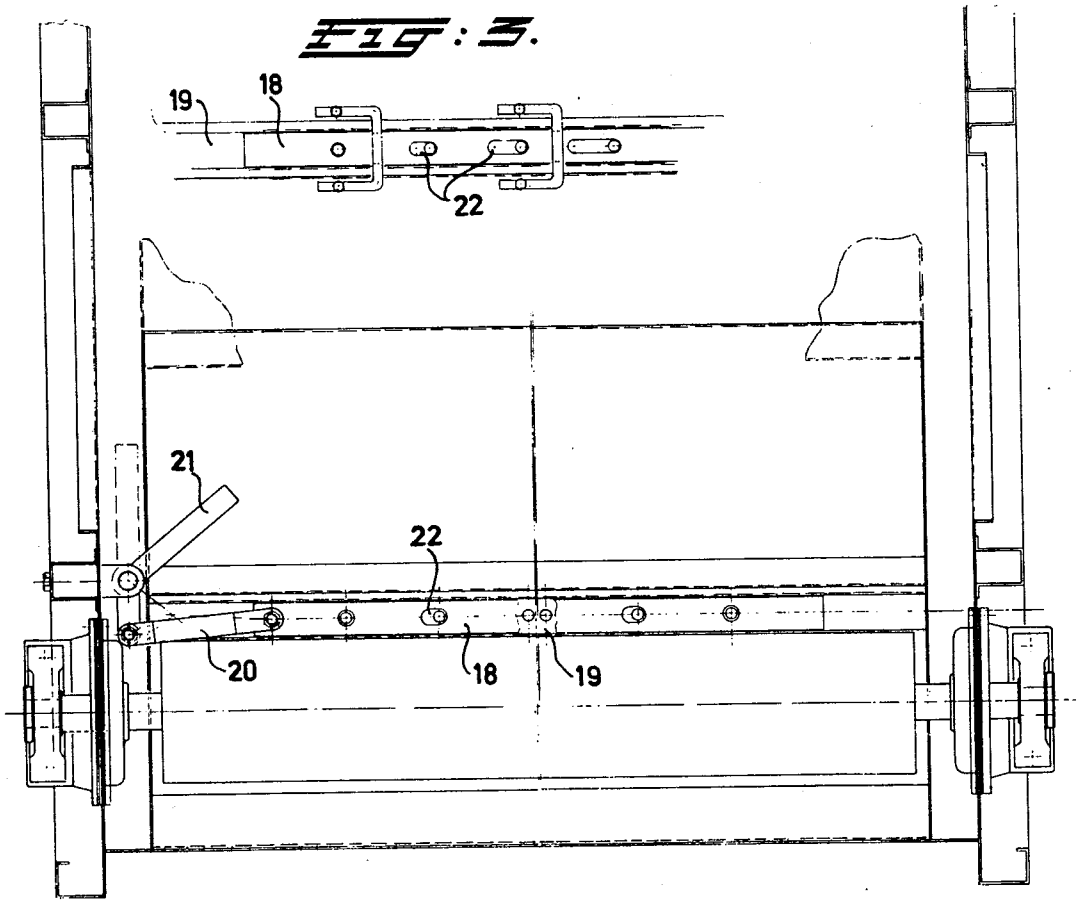
FIG. 2 shows an embodiment of the closing means on an enlarged scale.
FIG. 3 shows a detail of FIG. 2 to a still larger scale.

As is best seen in FIG. 3 the perforations 9 have a diameter $d$ and a distance $s$ between centerlines. The strip 18 has analogous perforations 22 with the same distance $s$ between centerlines. The perforations 22 have, however, starting from the ends of the strip 18 an increasingly oblong shape. The longer axis of these perforations is an ascending multiple of the diameter $d$ of the perforations 9.

In the left-hand final position of the strip 18, as shown in FIGS. 2 and 3, all perforations 9 are open, because all perforations 22 are lying over them. When now due to operation of the lever 21 the strip 18 is moved toward the right over a distance equal to the diameter of the perforation 22, then the two outermost perforations of the gutter 19 will be closed, while all other perforations remain open. In case of a second stepwise movement of the strip 18 toward the right the perforations next to the outermost perforations 9 will be closed too, while all more centrally located perforations remain open. In this manner the outer perforations 9 can be successively closed and the outflow width of each receptacle 7 be reduced. This may occur when a web with a width smaller than the maximally permissible width of web should be washed in the washing machine. In this manner washing liquid is prevented from flowing uselessly down through the receptacle without touching the cloth 3.

It should be noted that in use of the washing machine all receptacles 7 will be partially filled with cleaning liquid, while an equilibrium is established, due to the fact that via the perforations 9 a quantity of liquid flows continuously off, but at the same time from the roller situated above the receptacle a quantity of pressed out liquid flows thereinto. Via a pump (not shown) the cleaning liquid from the bath 5 is pumped to the container 10. It is also possible to discharge the liquid from the bath 5 and to feed exclusively fresh clean cleaning liquid to the container 10.

The advantages of the washing machine according to the invention may be summarized as follows:

the required floor surface of the apparatus is small with respect to the conventional web or cloth washing machines, since the length of the treatment path can be enlarged by increasing the number of rollers 2, that is to say by heightening the apparatus; the treatment path is two or three times as large as in the known apparatus;

the consumption of cleaning liquid can be limited by the very intensive rinsing of the web on following a plurality of horizontal loops;

the apparatus can be easily adapted to various widths of the web 3 without washing cleaning liquid.

What I claim is:

1. A washing machine for a textile web, or the like, comprising:

a treatment space;

a plurality of guide rollers in said space and said rollers all being oriented horizontally and all being parallel; said rollers being arranged in at least one group of two generally vertical rows of said rollers, with neighboring said rollers in a said row being adjacent to each other, wherein the textile web, or the like, is passed along a zig-zag path of generally horizontally traveling loops of textile web, with the web first wrapping around a said roller in one said row and then traveling generally horizontally to a said roller in the other said row and wrapping about that said roller in the other said row; and said rollers being so positioned along their respective said rows for enabling such travel of the web by means of said rollers in one said row being vertically staggered from the horizontally adjacent said rollers in the other said row;

a respective receptacle disposed under each said roller and the receptacle being away from the web such that the web does not contact the contents of the receptacle; each said receptacle having a width greater than the length of the said roller above that said receptacle; each said receptacle extending toward the other said row of rollers and of receptacles such that said receptacles of each said roller row overlap the said receptacles of the other said roller row, thereby blocking liquid drip down a row of said rollers and down said receptacles;

a controllable liquid outlet from each said receptacle;

cleaning liquid supply means above said group of rollers for supplying liquid at each vertical level of each said vertical row of rollers.

2. A washing machine for a textile web, or the like, comprising:

a treatment space;

a plurality of guide rollers in said space and said rollers all being oriented horizontally and all being parallel; said rollers being arranged in at least one group of two generally vertical rows of said rollers, with neighboring said rollers in a said row being adjacent to each other, wherein the textile web, or the like, is passed along a zig-zag path of generally horizontally traveling loops of textile web, with the web first wrapping around a said roller in one said row and then traveling generally horizontally to a said roller in the other said row and wrapping about that said roller in the other said row; and said rollers being so positioned along their respective said rows for enabling such travel of the web;

a respective receptacle disposed under each said roller; each said receptacle having a width greater than the length of the said roller above that said receptacle;

each said receptacle having a bottom; a controllable liquid outlet from said receptacle comprising its said bottom being provided with a row of perforations extending in a direction substantially transverse to the longitudinal direction of the loop of the web situated thereunder, closing means for selectively closing selected ones of said perforations in each said row thereof for varying the outlet of liquid from its said receptacle;

cleaning liquid supply means for supplying liquid at each vertical level of each said vertical row of rollers.

3. A washing machine according to claim 2, said closing means comprising a blocking strip with perforations therethrough, said blocking strip perforations being spaced a distance apart, said closing means being located on said receptacle perforated bottom, wherein said perforations in a said row on said bottom of each said receptacle, starting inwardly from the ends of said blocking strip, have an increasingly oblong shape, with the perforations at the ends having a respective diameter ($d$) in their dimension extending along said row and with the perforations further from the ends of the strip having a longer axis in their dimension extending along said row which is an ascending multiple of the diameter $d$ of the perforation nearest the ends of said strip and said perforations being spaced apart the identical distance between center lines $s$ of said perforations.

4. A washing machine according to claim 3, further comprising a recessed gutter-shaped part in each said receptacle in which the perforations of each receptacle are provided and in which said strip is also guided.

5. A washing machine according to claim 1, further comprising a dewatering nozzle located in the pathway of the web past all said rollers for blowing gas vapor across the web and a condenser accommodated underneath the nozzle for condensing the gas vapor and for thereby creating and warming up inflowing clean liquid, so that the consumption of energy is limited to a minimum.

* * * * *